US006079460A

United States Patent [19]

Ballan et al.

[11] Patent Number: 6,079,460

[45] Date of Patent: Jun. 27, 2000

[54] ROTARY FILLING MACHINE FOR FILLING CONTAINERS WITH LIQUIDS

[75] Inventors: Mauro Ballan, Cologna Veneta; Martino Biscardo, Soave; Pierluigi Allegro, Torri di Quartesolo, all of Italy

[73] Assignee: MBF S.p.A., Veronella, Italy

[21] Appl. No.: 09/097,641

[22] Filed: Jun. 16, 1998

[30] Foreign Application Priority Data

Jun. 20, 1997 [IT] Italy ..... VR97A0056

[51] Int. Cl.[7] ..... B65B 43/42

[52] U.S. Cl. ..... 141/145; 141/49; 141/54; 141/63; 141/87; 141/90; 141/292

[58] Field of Search ..... 141/145, 90, 91, 141/5, 85, 86, 87, 89, 144, 146, 147, 152, 284, 295, 293, 292, 47, 54, 56, 49, 50, 63, 64, 70

[56] References Cited

U.S. PATENT DOCUMENTS

| | | | |
|---|---|---|---|
| 1,010,909 | 12/1911 | Herd | 141/294 |
| 3,182,691 | 5/1965 | Vergobbi et al. | 141/5 |
| 4,024,896 | 5/1977 | Ishioka et al. | 141/90 |
| 4,207,932 | 6/1980 | Gilmour | 141/90 |
| 5,082,033 | 1/1992 | Weiss | 141/39 |
| 5,413,153 | 5/1995 | Zwilling et al. | 141/39 |

*Primary Examiner*—Henry J. Recla
*Assistant Examiner*—Peter deVore
*Attorney, Agent, or Firm*—Browdy and Neimark

[57] ABSTRACT

A rotary liquid container-filling machine has valve assemblies (3), mounted on a rotating platform (2), each of provided with a duct (4) intercepted by an obturator (5) for regulating the supply of liquid from a storage tank (6) to the container (7) and having an air return pipe (8). A centering cone (10) receives in abutment the mouth of the container (7) to cause opening of the obturator (5) mounted at the bottom of each valve assembly (3). A flushing station (14) associated with the rotating platform (2), but fixed with respect thereto, is provided with at least one collecting tray (15) which is moved by a linear actuator (16) so as to be positioned underneath the valve assemblies (3) passing above it. For this purpose first a actuator means (17) opens each obturator (5) when valve assemblies (3) pass above the collecting tray (15). Each valve assembly (3) also has a blow-in pipe (23) provided with an outlet mouth (60) connected to the bottom end of the pipe (4) to introduce inert gas inside the container (7) to be filled before, during and after a step involving filling of the container (7) itself. Each air return pipe (8) has a third valve (31) which is actuated to open and close by activation means (32) which is integral with the centering cone (10).

32 Claims, 7 Drawing Sheets

1
2
14
90
50
80
80
70
70

ROTARY FILLING MACHINE FOR FILLING CONTAINERS WITH LIQUIDS

BACKGROUND OF THE INVENTION

1. Field of the Invention

The present invention relates to a rotary falling machine for filling containers with liquids.

The machine in question is intended to be used in bottling plants of the type consisting of a rotating platform (or carousel) provided peripherally with a plurality of filling valve assemblies.

More particularly, the machine in question may be used optimally in the sector for the bottling of beverages such as wine, mineral water, etc.

2. Description of the Prior Art

According to the conventional technique, each filling valve assembly is provided with an obturator which regulates the supply of the liquid (for example wine) into a container (for example a bottle) arranged coaxially below the valve assembly.

The obturator is mounted inside a tubular duct designed to connect it to a storage tank from where the liquid descends by means of gravity into the containers. The duct has, mounted inside it, a pipe inside which the gas or air passes during some steps of the filling cycle.

The bottom part of this pipe has the function or regulating hydraulically the maximum level of the liquid inside the container which, when reached, causes hydraulic stoppage of the supply of liquid.

As is known, filling machines require frequent flushing operations in order to clean all the parts of the valve assemblies such that the bacterial level can be kept under control as far as possible.

These operations require circulation of the flushing fluid (consisting mainly of suitable aqueous solutions) in all the ducts where the liquid passes and where the air passes.

At present, the system most used for carrying out flushing involves the use of auxiliary containers (so-called "dummy bottles") which are mounted, during the flushing step, underneath each valve assembly, so as to open each obturator allowing the recirculation of the flushing liquid from the liquid duct to the a return pipe.

Recently, machines which are able to perform automatically insertion of the "dummy bottles" underneath the valve assemblies have become widespread. They avoid the need to perform long manual operations in order to prepare each valve assembly for the flushing operations and allow in particular the execution of the flushing cycles to be programmed automatically.

These latter automatic machines, although improving the performance compared to those requiring manual preparation, have some disadvantages.

The main defect lies in the fact that these machines of the known type, once the flushing cycle has been completed, discharge in a non-reusable manner onto the underlying plates (which carry the bottles) the flushing fluid present in each valve assembly.

This fact obviously results in loss of a considerable quantity of flushing fluid and in particular in the machine being soiled by the fluid itself.

It should be noted, therefore, that in this type of machine, whenever it is necessary to discharge the liquid being used (not only the flushing fluid, but also when the filling fluid is changed), the same problem is encountered, namely that of having to discharge onto tine machine itself that portion of liquid present in the valve assemblies which, being below the discharge level of the tank, cannot be emptied from below with opening of the obturators. This opening operation is in most cases performed manually and therefore requires that an operator be employed for a considerable amount of time. The flushing machines of the known type mentioned above are preceded, in the bottling process, by rinsing machines (with or without the insertion of inert gas aimed at cleaning the containers and reducing as far as possible the presence of oxygen inside them.

This is done because one of the main problems of the bottling process is to ensure preservation of the product, in particular to prevent oxidization as far as possible. In fact, as is known, the organoleptic and qualitative characteristics of some food products (such as wine) alter significantly, even if subject to a slight degree of oxidization.

Some rinsing machines used nowadays remove the air from the bottles by replacing it with inert gas (usually nitrogen or carbon dioxide), after which the bottles continue on conveyors as far as filling machines such as those in question. During this travel movement, part of the inert gas present in the (open) bottles is dispersed and replaced with air. Moreover, once filling of the bottles has been completed, extraction of the liquid supply duct creates a slight vacuum with consequent drawing-in of outside air into the bottle.

Another type of filling machine of the known type (called isobaric) solves the problem of oxidization by removal, during a first step, of all the air from the bottle (creating a vacuum of the order of 80–90% inside it) and injection of inert gas under pressure during a next step, prior to filling. This type of machine, however, is very costly, has a low productivity and requires that the bottles be subjected to pressures which may risk breaking them.

It should be noted, moreover, that the filling machines in question operate with the storage tank under a slight vacuum generated by special pumps. These pumps therefore regulate, with their action, the value of the pressure present inside the storage container. This regulating action is somewhat problematic in the case of machines provided with an air return pipe which results in the connection with the storage tank being kept open irrespective as to whether containers are present or not underneath the valve assemblies.

In fact, a continuous flow of air is able to enter through the pipes of the valve assemblies arranged in front of the machine (where, that is, no bottles are present).

This flow, on the one hand, does not allow easy adjustment of the pressure inside the tank and, on the other hand, continuously draws in outside air (which is therefore rich in oxygen) inside the storage tank, thus exposing the filling liquid to a high risk of oxidization.

Furthermore, the filling machines provided with air return pipes which are closed at the bottom when there are no containers (such as those provided with liquid supply ducts lined with external sheaths capable of descending and closing off the side holes through which the air passes when there are no containers are characterized by poor productivity. This is due to the fact that, when the obturator is opened, these machines must wait for a fairly long period of time in order to allow compensation between the pressure of the gaseous mixture present in the storage tank and the gaseous mixture present in the container to be filled.

The essential object of the present invention is therefore to overcome the drawbacks associated with the systems of the known type by providing a rotary filling machine which allows automatic flushing of all its parts to be performed without requiring the non-reusable discharging of the flushing liquid remaining in each valve assembly.

A further object of the present invention is that of providing a machine which is constructionally sample and operationally entirely reliable and allows an inert gas to be inserted inside the containers before, during and at the end of the filling step.

Another object of the machine in question is to provide rapid compensation between the pressure of the gas mixture present in the storage tank and that of the gas mixture present inside the container, while maintaining a high level of productivity and allowing easy regulation of the pressure of the gaseous mixture present in the storage tank.

SUMMARY OF THE INVENTION

These objects, together with others, are all achieved by the filling machine in question, essentially comprising a flushing station associated with a rotating platform, but fixed with respect thereto and provided with at least one collecting tray. This flushing station may be actuated by moving means so as to be operationally positioned underneath valve assemblies provided with an obturator, which pass over it. First actuator means are provided for performing opening of each obturator when the valve assemblies pass above the collecting tray. In accordance with a further characteristic feature of the invention, each valve assembly comprises a blow-in pipe provided with an outlet mouth connected to the bottom end of a liquid supply duct and designed to introduce inert gas inside the container to be filled. Morever, each air return pipe is provided with a first valve actuated so as to open and close by activation means integral with a centering cone mounted on each valve assembly.

BRIEF DESCRIPTION OF THE DRAWINGS

The technical features of the invention, according to the aforementioned objects, may be clearly understood from the contents of the claims indicated below and the advantages thereof will emerge more clearly the detailed description which follows, with reference to the accompanying drawings which illustrate a purely non-limiting example of embodiment thereof, in which:

DETAILED DESCRIPTION OF THE PREFERRED EMBODIMENTS

Figure 1:
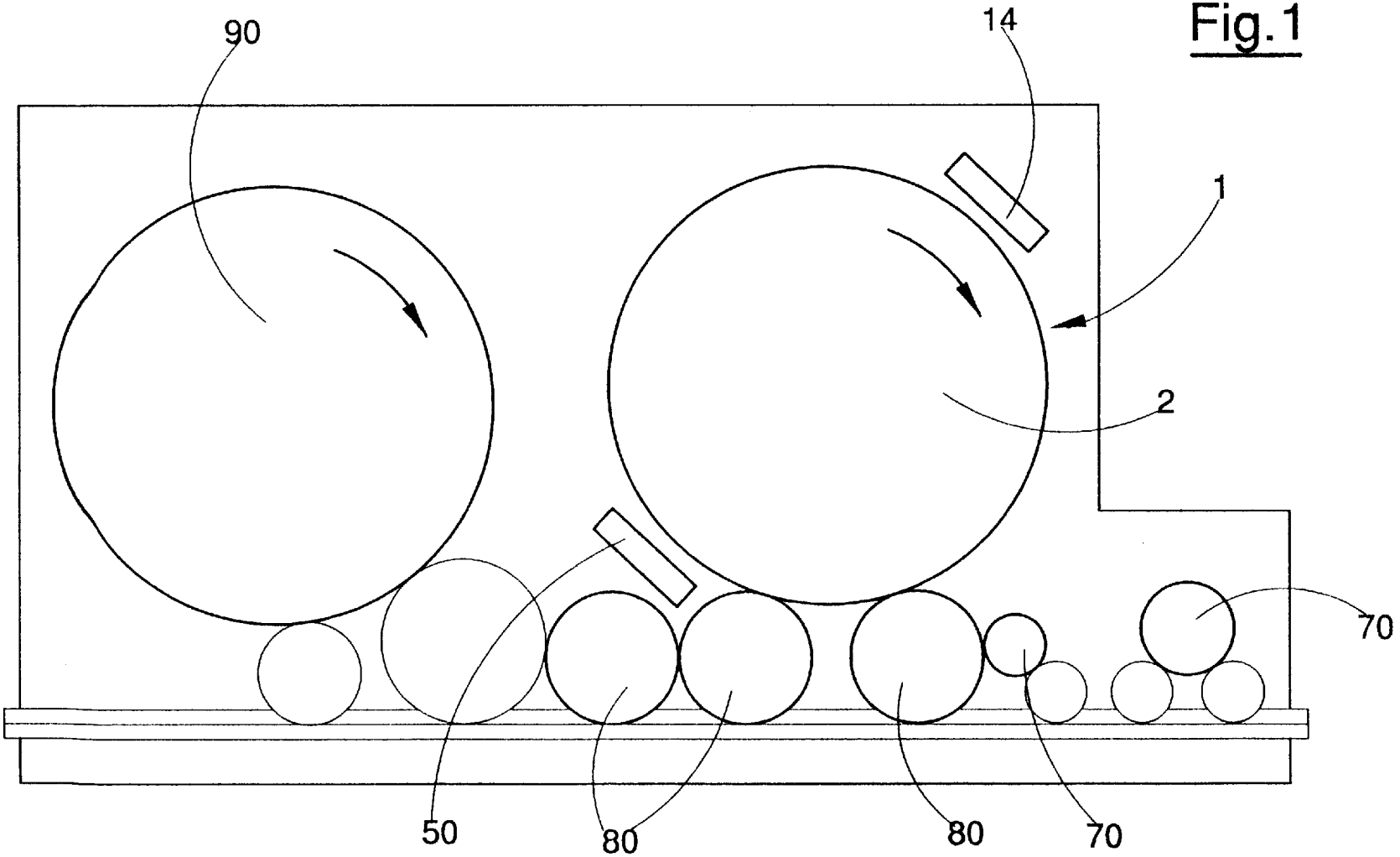
FIG. 1 shows a schematic view of a bottling plant incorporating the filling machine forming the subject of the present invention.

In accordance with the Figures of the accompanying drawings, 1 denotes in its entirety the rotary filling machine forming the subject of the present invention. Said machine is located (see FIG. 1), within a bottling plant, downstream of a rinsing machine 90 and upstream of sealing machines 70 and is operationally connected to the other machines by conveyors 80.

The machine 1 in question comprises essentially a rotating platform 2 provided peripherally with a plurality of filling valve assemblies 3, each of which is provided with a duct 4 intercepted by an obturator 5 for regulating the supply of liquid (for example wine) from an overhead storage tank 6 to an underlying container 7 to be filled (in examples illustrated, consisting of a bottle), and with an air return pipe 8 arranged, along a bottom section, inside the duct 4 and provided with an end section 9 for regulating hydraulically the maximum level of the liquid inside the container 7.

Figure 2:
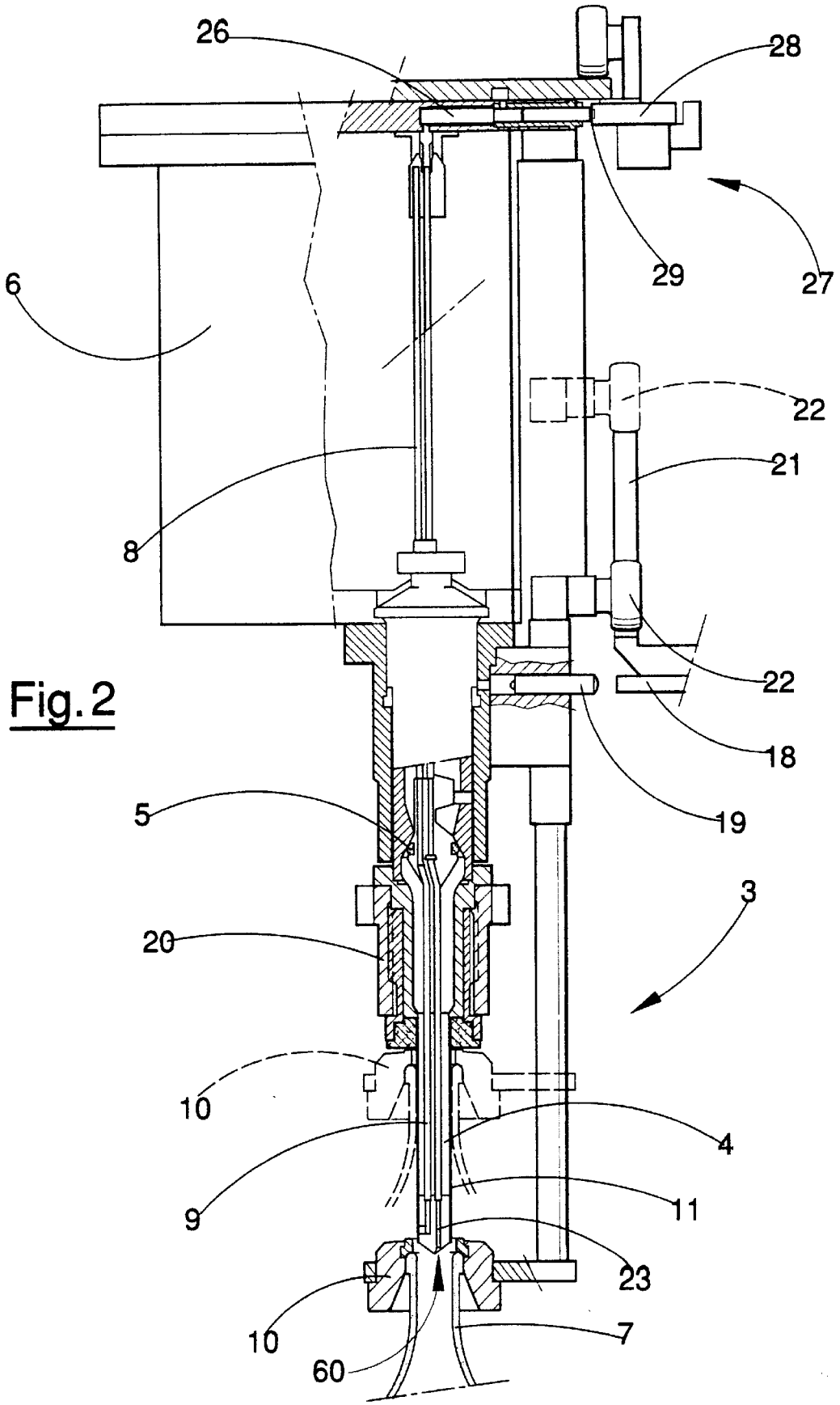
FIG. 2 shows a schematic sectional side view of a first example of embodiment of a valve assembly of the filling machine in question.
Figure 2A:
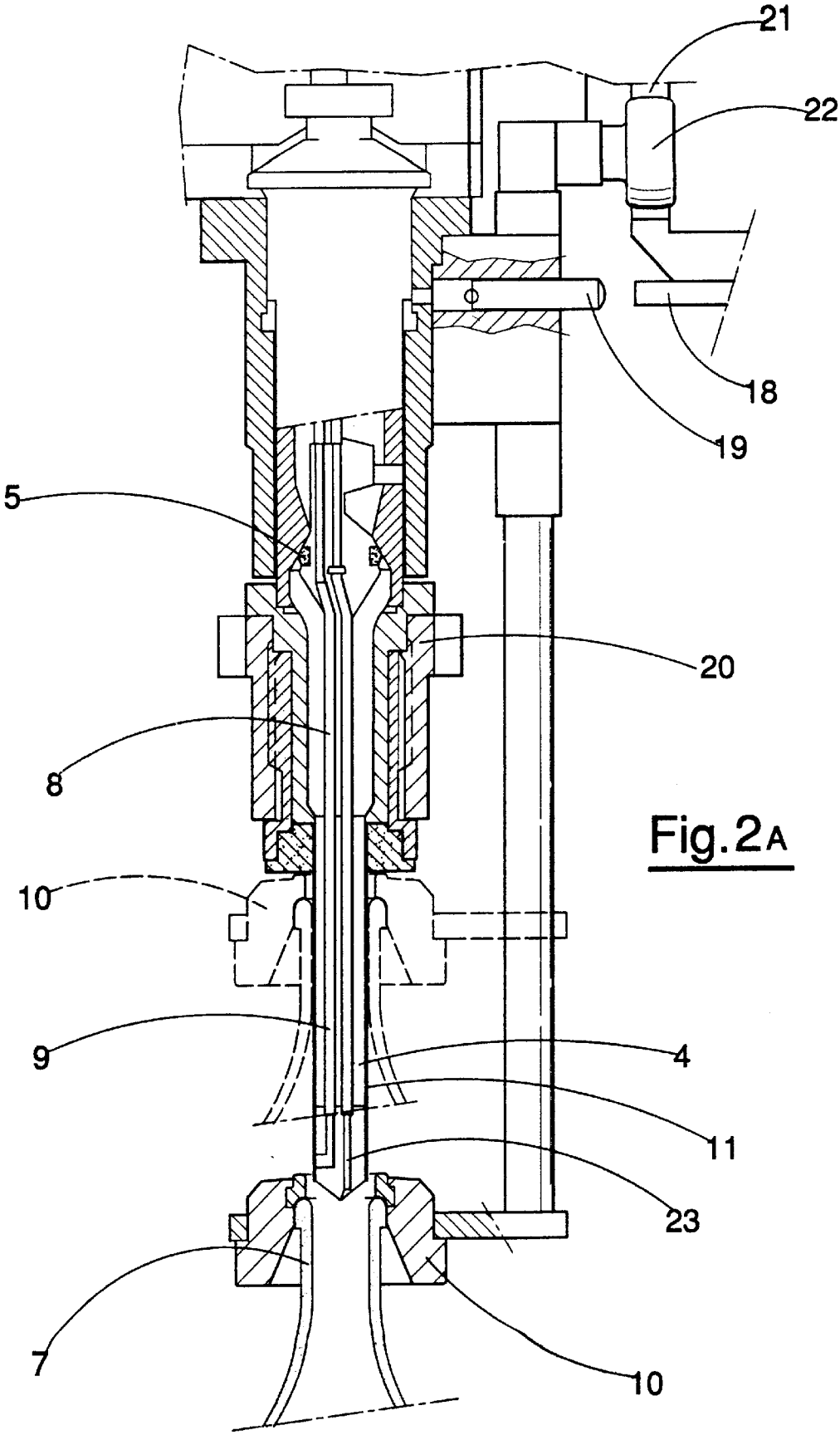
FIG. 2*a* shows a detail of FIG. 2 on a larger scale.

Each valve assembly 3 has, moreover, a centering cone 10 designed to receive in abutment the mouth of the container 7 and perform, with its raising movement, opening of the obturator 5 and, in the case of the example according to FIG. 2, opening of the air return pipe 8 as well, displacing upwards a movable sheathing 11 mounted externally around the duct 4.

Adjusting means or adjuster 12 are provided for moving the storage container 6 according to the height of the bottle 7 and, as will be clarified below, for displacing the storage tank 6 to a washing level 73.

Figure 4:
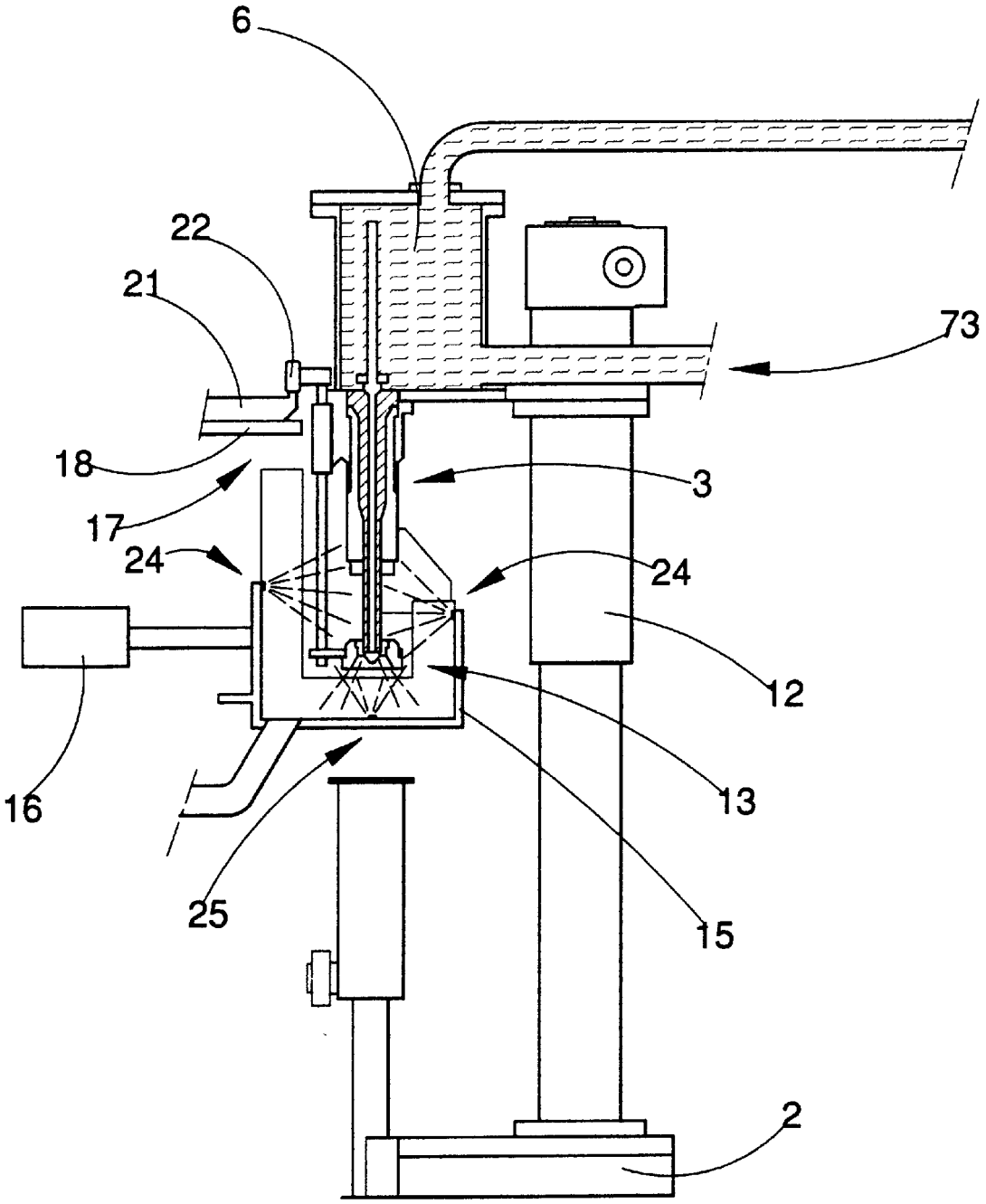
FIG. 4 shows a schematic sectional side view of a detail of the filling machine, relating to a flushing station.

The machine 1 is provided with a fixed flushing station 14 arranged in front of a sector of the rotating platform 2 (see FIG. 1) and provided with a collecting tray 15 actuated, during a corresponding flushing step, by moving means or, positing or linear actuator 16 so as to be positioned underneath the valve assemblies 3 passing above it. As seen in FIG. 4, the positioning actuator 16 is coupled to the collecting tray 15 by a member (unlabeled in FIG. 4);

When the valve assemblies 3 pass above the collecting tray 15, first actuator means or obturator actuator 17 cause opening of each obturator 5 for the section alone where the valve assemblies 3 pass over the collecting tray 15.

More in detail, the first actuator means 17 comprise a first cam 18 which is integrally associated with the collecting tray 15 and displaceable by said moving means 16 between an operating position and a non-operating position.

In the operating position the collecting tray 15 is positioned below the valve assemblies 3 and at the same time the first cam 18 actuates a first valve 19 mounted on each of the valve assemblies 3 for the whole period of time during which the valve assemblies 3 pass above the collecting tray 15.

Actuation of the first valve 19 causes, by means of pressurised air, raising of the movable part 20 of the valve assembly 3, with consequent opening of the obturator 5.

In the non-operating position (corresponding to the case where no flushing is performed) the collecting tray 15 is situated outside the trajectory of the valve assemblies 3. In this latter case the first cam 18 is correspondingly dissociated from each first valve 19. Advantageously (see FIG. 2) it is also envisaged using a second cam 21 integral with the first cam and designed to be combined with a corresponding first engaging element 22 mounted slidably on each of the valve assemblies 3. This makes it possible to raise each centering cone 10 up to a washing height 13 and open, in the case of the example according to FIG. 3, a third valve 31 mounted on the air return pipe, when the valve assemblies 3 pass above the collecting tray 15 during the flushing step. At the washing height 13, the flushing fluid covers in a parallel manner the internal walls of the centering cone 10 (see FIG. 4).

With reference to FIG. 4, the collecting tray 15 is provided with a plurality of nozzles designed to wash externally, during the flushing procedure, with jets of flushing fluid, each of the valve assemblies 3 while the pass above the collecting tray 15.

The nozzles (see FIG. 4) are divided up so as to form two series of nozzles 24 mounted on two opposite walls of the retaining tray and a central series of nozzles 25 mounted on the bottom of the collecting tray 15.

Positioning of the collecting tray 15 in the operating position involves:

a first step consisting in positioning of the storage tank 6 at a greater height, a second step consisting in positioning of the tray below the valve assemblies 3; a third step consisting in the lowering again of the storage tank 6 to a washing height 73. The adjusting means 12 which produce the vertical movement of the storage tank 6, allowing the execution of the steps mentioned above, may advantageously consist of pneumatic actuators.

In brief the execution of a flushing cycle of the machine therefore involves:

the arrangement (as mentioned above) of the collecting tray 15 in the operating position below the trajectory of the valve assemblies 3;

supplying of the machine 1 with the flushing fluid which, in the section above the collecting tray 15, passes through both the duct 4 and the air return pipe following opening thereof due to actuation of the first valve 19 by the first cam 18. Each valve assembly 3 is also washed externally along the section which passes above the collecting tray 15 by jets of flushing fluid;

at the end of the cycle, interruption of the supply fluid; fluid and discharging, into the collecting tray 15, of the flushing fluid contained in the valve assemblies 3;

disengagement of the collecting tray 15 and its arrangement in a non-operating position outside the trajectory of the valve assemblies 3.

It should be noted that the technology introduced with the flushing station 14 in order to perform flushing of the machine 1 may also be advantageously used every time it is required to change filling product and the machine 1 must therefore be emptied completely.

Figure 5:
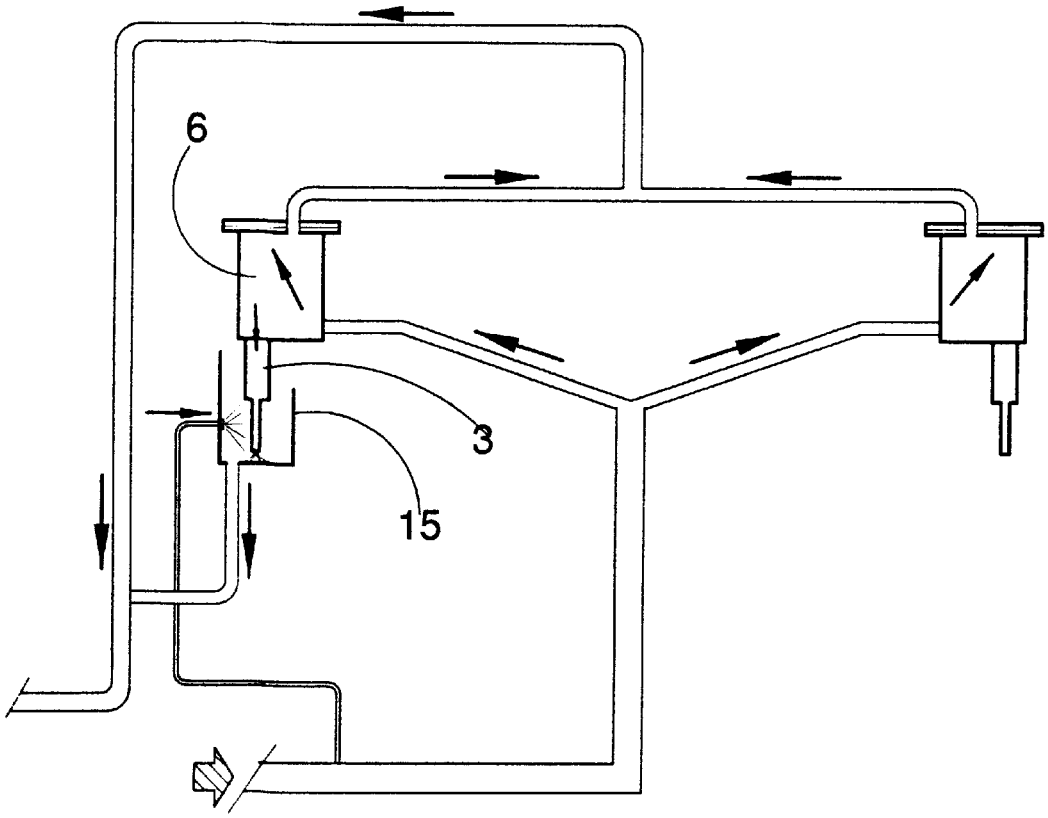
FIG. 5 shows a logic diagram of the flushing liquid circuit.

In such a case, in fact, once the supply to the tank 6 has been interrupted and the liquid discharged from it, it is possible to discharge the portion of liquid left inside the valve assemblies 3, arranging the collecting tray 15 in the operating position and causing the rotating platform 2 to perform at least one turn. The liquid collected in the tray 15 may be recycled via a system of pipes shown by way of example in FIG. 5 which in fact shows a possible logic diagram of the flushing fluid circuit.

With reference to FIG. 2, each valve assembly 3 has, associated with it, a blow-in pipe 23 provided with an outlet mouth 60 connected to the bottom end of the pipe 4 and designed to introduce inert gas into the container 7 in order to reduce the quantity of oxygen which would be absorbed by the liquid during a step where the container 7 is filled.

In the case of the example illustrated in FIG. 2, the blow-in pipe 23 is inserted inside the duct 4 parallel to the air return pipe 8.

The introduction of inert gas inside the container 7 by means of the abovementioned blow-in pipe 23 is performed in three different stages.

A first quantity of inert gas is introduced prior to the step of filling with the liquid in a step involving removal of the air from the container 7.

A second quantity of inert gas is introduced during the filling step in order to protect the laminar flow of the liquid which descends into the container from the air/gas mixture which returns from the container. The inert gas, in fact, lines with a thin veil the liquid descending into the container so as to prevent the return air/gas mixture from making contact with the liquid.

Finally, a third quantity of inert gas is introduced at the end of the filling step during a step involving disengagement of the duct 4 from the container 7.

In order to perform the abovementioned steps the blow-in pipe 23 is intercepted by a second valve 26 actuated by second actuator means 27 designed to regulate the supply of inert gas which passes through it.

The second actuator means 27 comprise a third cam 28 which is mounted fixed with respect to the rotating platform 2 in a special blow-in station 50 and acts on a corresponding second engaging element 29 connected to each second valve 26 so as to perform opening and closing thereof in accordance with predetermined operating steps. According to the embodiment shown in FIG. 3, the air return pipe 8 has an outlet mouth 30 which is arranged at the bottom and centrally with respect to the duct 4 and which remains open independently of the position of the centering cone 10 (raised or lowered). At the top end the aforementioned pipe 8 is intercepted by a third valve 31 actuated so as to open and close by activation means 32 integral with the centering cone 10.

More in detail, the third valve 31 is open in a raised position of the centering cone 10 and is closed in a lowered position of the centering cone 10. Therefore, the first case (cone 10 raised and third valve 31 open) the obturator 5 is also open and supplying of the liquid into the container 7 and return of the air into the storage container 6 occur at the same time, while in the second case the obturator 5 is closed and both supplying of the liquid into the container 7 and return of the air into the storage tank 6 is prevented.

Figure 3:
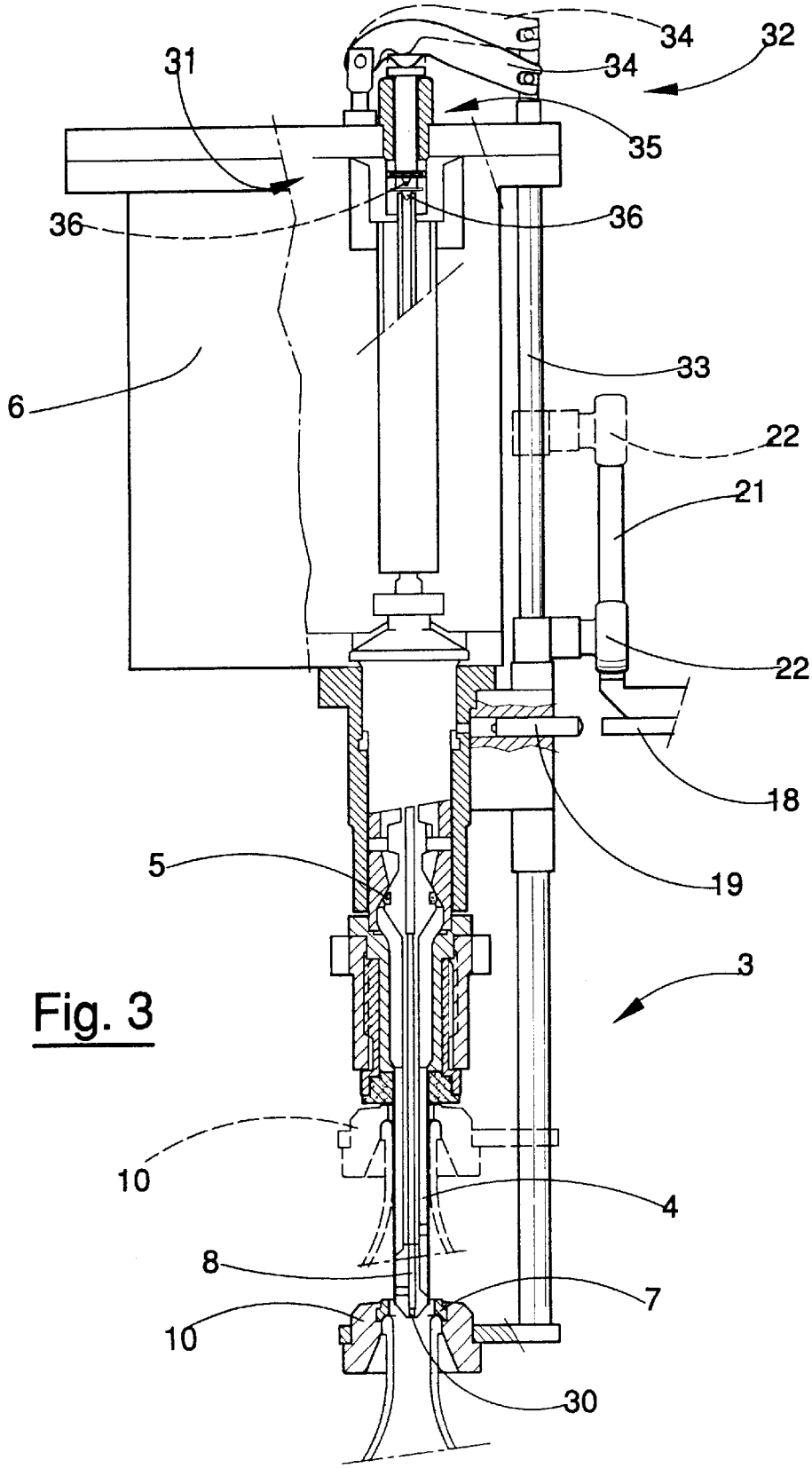
FIG. 3 shows a schematic sectional side view of a second example of embodiment of the valve assembly of the filling machine in question.
Figure 3A:
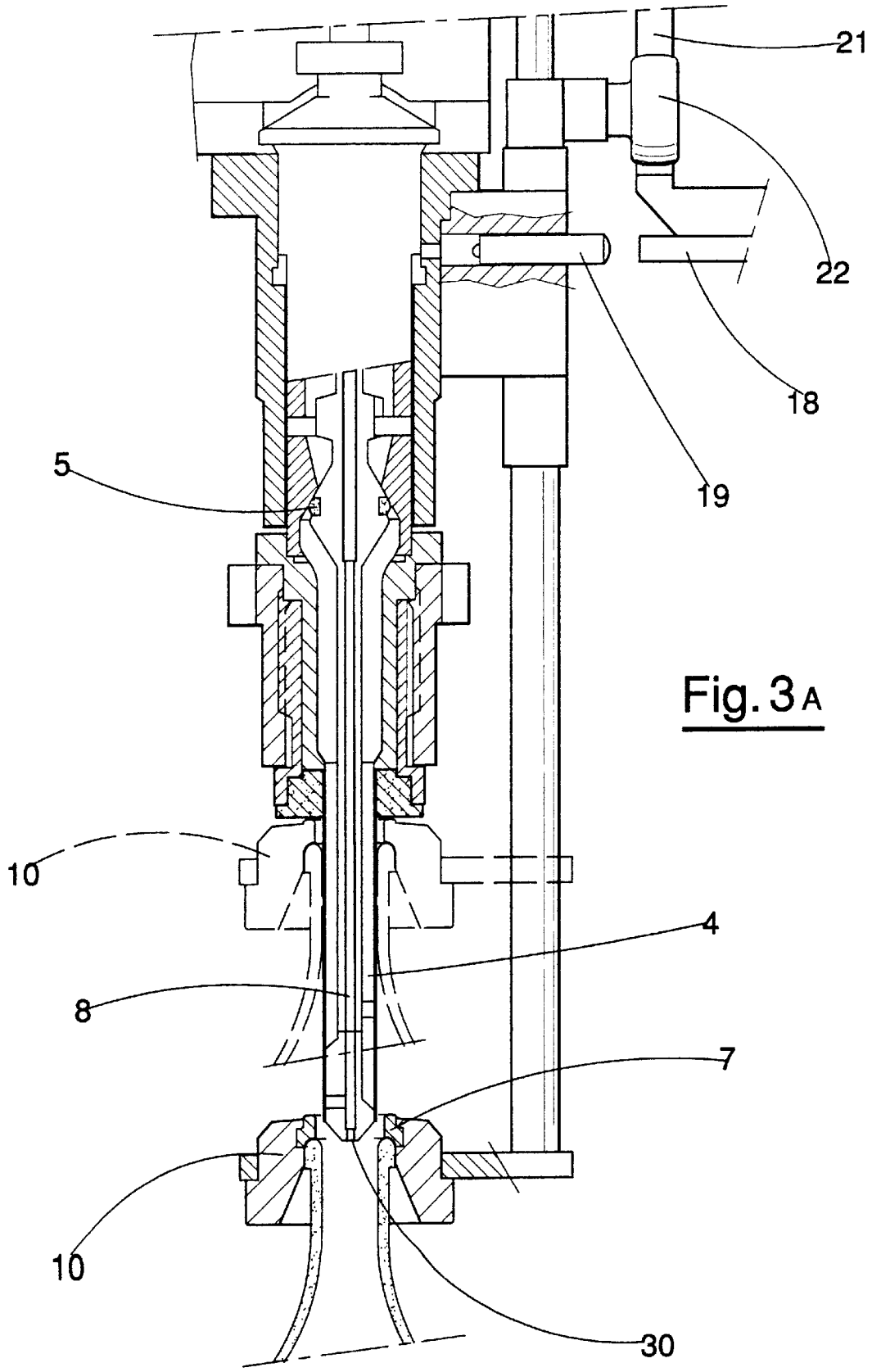
FIG. 3*a* shows a detail of FIG. 3 on a larger scale.

In the case of the example according to FIG. 3, the activation means 32 consist essentially of a row 33 connected at its bottom end to the centering cone 10 and hinged at its top end to a rocker arm 34. The latter performs, by means of mechanical transmission devices 35, the opening movement of the obturator 36 of the third valve 31, when the centering cone 10 is in the raised position, and the closing movement of the obturator 36, when the centering cone 10 is in the lowered position.

The presence of this third valve 31 thus makes it possible to achieve, at the start of the filling step, rapid cleaning of the pipe 8 according to FIG. 3 and consequent compensation of pressures between the gaseous mixture present in the storage container 6 and the gaseous mixture present in the container 7 to be filled.

A further advantage resulting from the presence of the third valve 31 is a direct consequence of the fact that all the valve assemblies 3 without bottles have the third valve 31 in the closed position. As a result the value of the vacuum present inside the storage container 6 may be easily regulated. In fact, in this way, it is avoided having to continuously draw from inside the tank 6 (which is in fact harmful for the product to be bottled), with outside air being drawn in by the assemblies devoid of bottles, which would otherwise occur if this third valve 31 were not present.

What is claimed:

1. A rotary filling machine for filling a container, with liquids, of the type including a rotating platform (2) including a plurality of peripheral filling valve assemblies (3), each of which further comprises:

a duct (4) for supplying the liquid from a storage tank (6) to the container (7) to be filled with said liquid, when the container is positioned underneath the duct (4); an obturator (5) intercepting said duct (4) in order to regulate a supply of liquid towards the container (7); an air return pipe (8) along at least a section inside said duct (4) and including an end section for hydraulically regulating a maximum level of the liquid inside the container (7); a centering cone (10) designed to receive in abutment a mouth of said container (7) and to cause opening of said obturator (5); and an adjuster (12) moving said storage tank (6) and being connected to said valve assemblies (3);

said filling machine comprising at least one fixed flushing station (14) in stationary relationship to said rotating platform (2), including at least one respective collecting tray (15), a positioning actuator (16) moving, in accordance with predetermined operating steps, said collecting tray (15) to an operational position underneath one of said valve assemblies (3) passing above it, and an obturator actuator (17) opening each obturator (5) when a respective valve assembly (3) passes above said collecting tray (15).

2. The machine as claimed in claim 1, wherein said obturator actuator (17) comprises at least a first cam (18) integrally associated with said collecting tray (15) displaceable by said positioning actuator (16) between an operating position, in which said collecting tray (15) is positioned underneath said respective valve assembly (3), said first cam (18) actuating at least a first valve (19) mounted respectively on each of said valve assemblies (3) while the respective valve assembly passes above said collecting tray (15), said first valve (19) opening, by means of a fluid under pressure, the obturator (5) of each said valve assembly (3), and a non-operating position in which said collecting tray (15) is situated outside the trajectory of said valve assemblies (3), said first cam (18) being in this case operationally dissociated from each first valve (19).

3. The machine as claimed in claim 2, comprising at least a second cam (21) integral with the first cam and designed to be combined, when said collecting tray (15) is arranged in said operating position, with a corresponding first engaging element (22) slidably mounted on each of said valve assemblies (3), mutual contact between said engaging element and said second cam (21) causing raising of each said centering cone (10) up to a washing height (13) and opening of a third valve (31) of said air return pipe (8) when said valve assemblies (3) pass above said collecting tray (15).

4. The machine as claimed in claim 3, wherein said collecting tray (15) is provided with a plurality of nozzles designed to wash externally with jets of flushing fluid each of said valve assemblies (3), when the latter pass opposite said collecting tray, a flushing procedure with said flushing fluid including the arrangement of said collecting tray (15) in said operating position being activated for this purpose.

5. The machine as claimed in claim 4, wherein said plurality of nozzles is formed by at least two series of nozzles (24) mounted on two opposite walls of said retaining tray and at least a central series of nozzles (25) mounted on the bottom of said collecting tray (15).

6. The machine as claimed in claim 3, wherein, when said centering cone (10) is at the washing height (13), a flushing fluid covers in a parallel manner the internal walls thereof.

7. The machine as claimed in claim 2, wherein the positioning of the collecting tray (15) in the operating position involves:

a first step consisting in positioning of the storage tank (6) at a greater height, a second step consisting in positioning of the tray underneath the valve assemblies (3), a third step consisting in lowering again of the storage tank (6) to a washing height (73), said adjuster (12) consisting of linear actuators designed to produce the vertical movement of said storage tank (6).

8. The machine as claimed in claim 1, wherein said positioning actuator (16) comprises at least one linear actuator designed to displace said tray between said operating position and said non-operating position.

9. The machine as claimed in claim 1, wherein, once discharging of said storage tank (6) has been performed and said collecting tray (15) has been arranged in the operating position, said collecting tray (15) is designed to receive the portion of liquid left inside said valve assemblies (3) at a height less than discharging of said storage tank (6), a first valve (19) activating for this purpose opening of each obturator (5) and each air return pipe while each valve assembly (3) passes above said collecting tray (15).

10. The machine as claimed in claim 1, wherein each valve assembly (3) comprises a blow-in pipe (23) provided with an outlet mouth (60) connected to the bottom end of said duct (4) and designed to introduce inert gas inside said container (7) in order to reduce the presence of oxygen which would by absorbed by the liquid during a step where said container (7) is filled.

11. The machine as claimed in claim 10, wherein, via said blow-in pipe (23), a first quantity of inert gas is introduced inside the container (7) during a step involving removal of the air from said container (7) prior to said step consisting in filling with the liquid.

12. The machine as claimed in claim 10, wherein, via said blow-in pipe (23), a quantity of inert gas is introduced inside the container (7) during a compensation step aimed at protecting the laminar flow of the liquid which descends into the container (7) from the air/gas mixture which returns from the container (7) during said filling step.

13. The machine as claimed in claim 10, wherein, via said blow-in pipe (23), a quantity of inert gas is introduced inside the container (7) during a step involving disengagement of said duct (4) from said container (7) after the end of said filling step.

14. The machine as claimed in claim 10, wherein said blow-in pipe (23) is mounted inside said liquid supply duct (4) and is intercepted by a second valve (26) actuated by second actuator (27) designed to regulate the supply of inert gas which passes through it.

15. The machine as claimed in claim 14, wherein said second actuator (27) comprise at least a third cam (28) which is fixed with respect to the rotating platform (2) in a special blow-in station (5) and designed to be combined, when said container (7) is arranged at the bottom of said valve assembly (3), with a corresponding second engaging element (29) connected to each second valve (26), the mutual contact between said second engaging element (29) and said third cam (28) causing opening and closing of said second valve (26).

16. The machine as claimed in claim 1, wherein said air return pipe (8) is provided with a third valve (31) actuated so as to open and close by activation means (32) integral with the centering cone (10), respectively in a raised position of said centering cone (10), with reference to which said obturator (5) is open, causing simultaneously supplying of the liquid into the container (7) and return of the air by means of said pipe via said third valve (31), and in a lowered position of said centering cone (10), with reference to which said obturator (5) is closed, not causing either supplying of the liquid into the container (7) or the return of air by means of said pipe via said third valve (31).

17. The machine as claimed in claim 1, wherein said air return pipe (8) has at least one outlet mouth (30) which remains open independently of the position of said centering cone (10) and is provided with a third valve (31) actuated so as to open and close by activation means (32) integral with the centering cone (10), respectively in a raised position of said centering cone (10), with reference to which said obturator (5) is open, causing simultaneously supplying of the liquid into the container (7) and return of the air by means of said pipe via said third valve (31), and in a lowered position of said centering cone (10), with reference to which said obturator (7) is closed, not causing either supplying of the liquid into the container (7) or return of the air by means of said pipe via said third valve (31).

18. The machine as claimed in claim 16, wherein said activation means (32) consist essentially of at least one rod (33) connected at its bottom end to said centering cone (10) and hinged at its top end to a rocker art (34) designed to perform, by means of mechanical transmission devices (35), the opening movement of the obturator (36) of said third valve (31), when said centering cone (10) is in the raised position, and the closing movement of the obturator (36) of said third valve (31), when said centering cone (10) is in the lowered position.

19. The machine as claimed in claim 1, wherein, when said centering cone (10) is in said raised position and the mouth of said container (7) is sealingly arranged on it, at the same time as opening of a third valve (31), rapid cleaning of the non-return pipe (8) and consequent compensation of pressures between the gaseous mixture present in the storage tank (6) and the gaseous mixture present in the container (7) to be filled take place.

20. The machine as claimed in claim 1, wherein the valve assemblies (3) without bottles each have a third valve (31) in the closed position, thereby allowing adjustment of the value of the pressure present inside the storage container (6).

21. The machine as claimed in claim 1, wherein the positioning of the collecting tray (15) in the operating position involves:

a first step consisting in positioning of the storage tank (6) at a greater height, a second step consisting in positioning of the tray underneath the valve assemblies (3), a third step consisting in lowering again of the storage tank (6) to a washing height (73), said adjuster means (12) consisting of linear actuators designed to produce the vertical movement of said storage tank (6).

22. A rotary filling machine for filling containers with liquids, of the type consisting of a rotating platform (2) provided peripherally with a plurality of filling valve assemblies (3), each of which is provided with: a duct (4) for supplying the liquid from a storage tank (6) to a container (7) to be filled with said liquid, positioned underneath the duct (4); an obturator (5) arranged so as to intercept said duct (4) in order to regulate the supply of liquid towards the container (7); an air return pipe (8) arranged along at least a section inside said duct (4) and provided with an end section for hydraulically regulating the maximum level of the liquid inside the container (7); a centering cone (10) designed to receive in abutment the mouth of said container (7) and to cause opening of said obturator (5); adjusting means (12) designed to move said storage tank (6) and connected to said valve assemblies (3); said machine comprising at least one flushing station (14) in stationary relationship to said rotating platform (2) and provided with at least one collecting tray (15), said flushing station (14) being able to be actuated by moving means (16) so as be positioned operationally, in accordance with predetermined operating steps, underneath said valve assemblies (3) passing above it, first actuator means (17) being provided so as to cause opening of each obturator (5) when said valve assemblies (3) pass above said collecting tray (15).

23. The machine as claimed in claim 22, wherein said first actuator means (17) comprise at least a first cam (18) integrally associated with said collecting tray (15) and displaceable by said moving means (16) between an operating position, in which said collecting tray (15) is positioned underneath said valve assemblies (3), said first cam (18) actuating at least a first valve (19) mounted on each of said valve assemblies (3) while the latter pass above said collecting tray (15), said first valve (19) being designed to open, by means of a fluid under pressure, the obturator (5) of each said valve assembly (3) and the corresponding air return pipe (8), and a non-operating position in which said collecting tray (15) is situated outside the trajectory of said valve assemblies (3), said first cam (18) being in this case operationally dissociated from each first valve (19).

24. The machine as claimed in claim 23, comprising at least a second cam (21) integral with the first cam and designed to be combined, when said collecting tray (15) is arranged in said operating position, with a corresponding first engaging element (22) slidably mounted on each of said valve assemblies (3), mutual contact between said engaging element and said second cam (21) causing raising of each said centering cone (10) up to a washing height (13) when said valve assemblies (3) pass above said collecting tray (15).

25. The machine as claimed in claim 24, wherein said collecting tray (15) is provided with a plurality of nozzles designed to wash externally with jets of flushing fluid each of said valve assemblies (3), when the latter pass opposite said collecting tray (15), a flushing procedure with said flushing fluid including the arrangement of said collecting tray (15) in said operating position being activated for this purpose.

26. The machine as claimed in claim 25, wherein said plurality of nozzles is formed by at least two series of nozzles (24) mounted on two opposite walls of said retaining tray and at least one central series of nozzles (25) mounted on the bottom of said collecting tray (15).

27. The machine as claimed in claim 24, wherein, when said centering cone (10) is at the washing height (13), a flushing fluid covers in a parallel manner the internal walls thereof.

28. The machine as claimed in claim 23, wherein the positioning of the collecting tray (15) in the operating position involves:

a first step consisting in positioning of the storage tank (6) at a greater height, a second step consisting in positioning of the tray underneath the valve assemblies (3), a third step consisting in lowering again of the storage tank (6) to a washing height (73), said adjusting means (12) consisting of linear actuators designed to produce the vertical movement of said storage tank (6).

29. The machine as claimed in claim 22, wherein said moving means (16) comprise at least one linear actuator designed to displace said tray between said operating position and said non-operating position.

30. The machine as claimed in claims 22, wherein the positioning of the collecting tray (15) in the operating position involves:

a first step consisting in positioning of the storage tank (6) at a greater height, a second step consisting in positioning of the tray underneath the valve assemblies (3), a third step consisting in lowering again of the storage tank (6) to a washing height (73), said adjusting means (12) consisting of linear actuators designed to produce the vertical movement of said storage tank (6).

31. The machine as claimed in claim 22, wherein, once discharging of said storage tank (6) has been performed and said collecting tray (15) has been arranged in the operating position, said collecting tray (15) is designed to receive the portion of liquid left inside said valve assemblies (3) at a height lower than the discharge of said storage tank (6), a first valve (19) activating for this purpose opening of each obturator (5) and each air return pipe while each valve assembly (3) passes above said collecting tray (15).

32. The machine as claimed in claim 22, wherein said first actuator means (17) simultaneously cause opening of the each obturator (5) and each corresponding air return pipe (8) when said valve assemblies (3) pass above said collecting tray (15).

* * * * *